US005277597A

United States Patent [19]

Masami et al.

[11] Patent Number: 5,277,597

[45] Date of Patent: Jan. 11, 1994

[54] THIN, APPLIED-TO-SURFACE TYPE OF ELECTRIC CONNECTOR

[75] Inventors: Sasao Masami, Kawasaki; Junichi Miyazawa, Yokohama, both of Japan

[73] Assignee: Molex Incorporated, Lisle, Ill.

[21] Appl. No.: 29,197

[22] Filed: Mar. 10, 1993

[30] Foreign Application Priority Data

Apr. 18, 1992 [JP] Japan ..... 4-32745[U]

[51] Int. Cl.[5] ..... H01R 23/72

[52] U.S. Cl. ..... 439/83; 439/660

[58] Field of Search ..... 439/62, 65, 74, 83, 439/876, 660

[56] References Cited

U.S. PATENT DOCUMENTS 4,655,518 4/1987 Johnson et al. ..... 439/80
4,678,250 7/1987 Romine et al. ..... 439/83
4,695,106 9/1987 Feldman et al. ..... 439/83
5,145,384 9/1992 Asakawa et al. ..... 439/83
5,161,985 11/1992 Ramsey ..... 439/74

*Primary Examiner*—Neil Abrams
*Attorney, Agent, or Firm*—Stephen Z. Weiss; Charles S. Cohen

[57] ABSTRACT

Disclosed is an improvement relating to a thin, applied-to-surface type of electric connector comprising a housing 1 and a plurality of terminals 7, 10 fixed thereto. Each terminal has a solder tail 8, 11 extending outward under the bottom of the housing to be positioned on a selected conductor of a printed circuit board for subjecting to automatic soldering. The distance N between the ends of opposed solder tails is shorter than the maximum lateral size L of the housing 1. Both sides of the housing 1 have a chamfer 13 along its lower longitudinal part. The ends 7A, 10A of the terminals and their receiving cavities 25 may be slanted to hold the terminals within the housing and prevent stubbing.

4 Claims, 4 Drawing Sheets

THIN, APPLIED-TO-SURFACE TYPE OF ELECTRIC CONNECTOR

FIELD OF INVENTION the present invention relates to an improvement in surface mounted electric connectors and particularly to a connector comprising a housing and a plurality of terminals fixed to said housing, each terminal having a soldering tail extending outward under the bottom of said housing to be put on a selected conductor in a printed circuit board for soldering thereto.

DESCRIPTION OF PRIOR ART

As is well known, surface mounted electric connectors have been widely used. When such an electric connector is used, the soldering tails of the terminals thereof are put on selected conductors of a printed circuit board, and solder applied beneath such soldering tails is heated and melted by exposing to infrared rays or heated air so that the selected conductors on the circuit board may be soldered to the terminals of the electric connector.

The solder tails of such surface mount connectors typically extend a substantial distance beyond the opposite sides of the housing, thereby assuring that solder applied to the terminal tails is fully exposed to infrared rays or heated air and that solder is completely melted to provide good soldering. The substantial extension of the solder tails out of the opposite sides of the connector housing requires extra space on the printed circuit board, and this is contradictory to the trend of reduction of the printed circuit board size.

In an attempt to meet the demand of size reduction it has been proposed that the lateral size of the connector housing be reduced. This approach, however, may cause the buckling of the connector housing when applied to the printed board if the lateral size of the connector housing should be reduced too far.

SUMMARY OF THE INVENTION

One object of the present invention is to provide a surface mounted electric connector structure which permits the required space to be reduced yet still maintaining a sufficiently stiff housing and permit the terminal tails to be fully exposed to infrared rays or heated air to provide good soldering.

To attain this object, a thin, surface mounted electric connector comprising a housing and a plurality of terminals fixed to said housing is disclosed. Each terminal has a solder tail extending outward under the bottom of the housing to be put on a selected conductor of a printed circuit board for subjecting to automatic soldering. Generally stated an improvement according to the present invention is that the distance N between the tail end of each terminal attached to the front side of said housing and the tail end of each terminal attached to the rear side of said housing is shorter than the maximum lateral size L of said housing and the edges of the tails remain within the maximum lateral size L of said housing.

In addition, each of the front and rear sides of said housing has a chamfer along its lower longitudinal part, thus permitting the bending of the tail end of each terminal. The chamfer may be formed by partly removing the lower edge of each of the front and rear sides in the form of a triangle to provide a slanted surface along the lower longitudinal part of each side. Alternatively, the chamfer may be formed by partly removing the lower edge of each of the front and rear sides in the form of a rectangle to provide a rectilinear recess along the lower longitudinal part of each side.

With this arrangement, no terminal tails extend beyond the opposite sides of the housing, and thus require no extra space to mount the electrical connector to a printed circuit board. The terminal tails are still exposed to heated air or infrared rays so that solder applied to the terminal tails may be melted in order to permit the soldering of the terminal tails to selected conductors on the printed board.

BRIEF DESCRIPTION OF THE DRAWINGS

Other objects and advantages of the present invention will be understood from the following description of thin, applied-to-surface type of electric connectors according to preferred embodiments of the present invention, which are shown in accompanying drawings.

DETAILED DESCRIPTION OF THE PREFERRED EMBODIMENT

Figure 1:
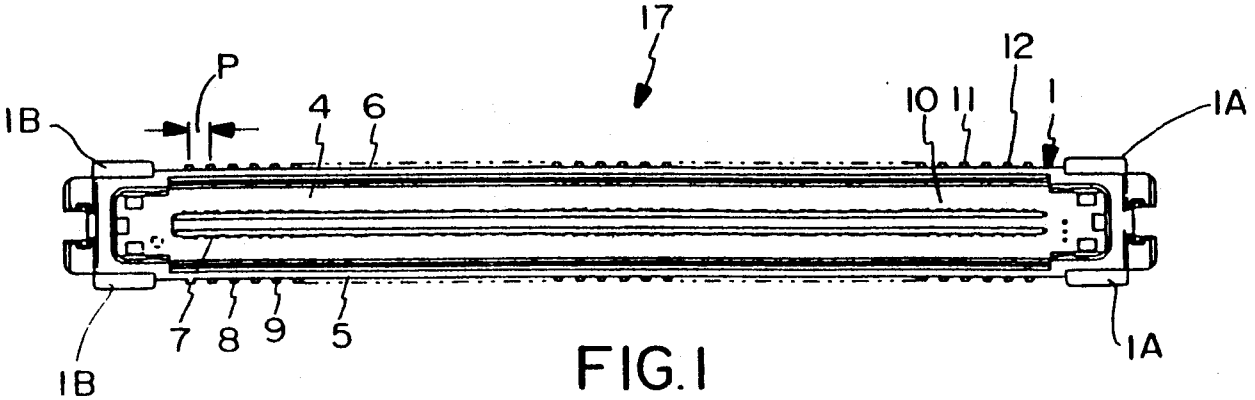
FIG. 1 is a plan view of the female part of a thin, applied-to-surface type of electric connector according to a first embodiment of the present invention.
Figure 2:
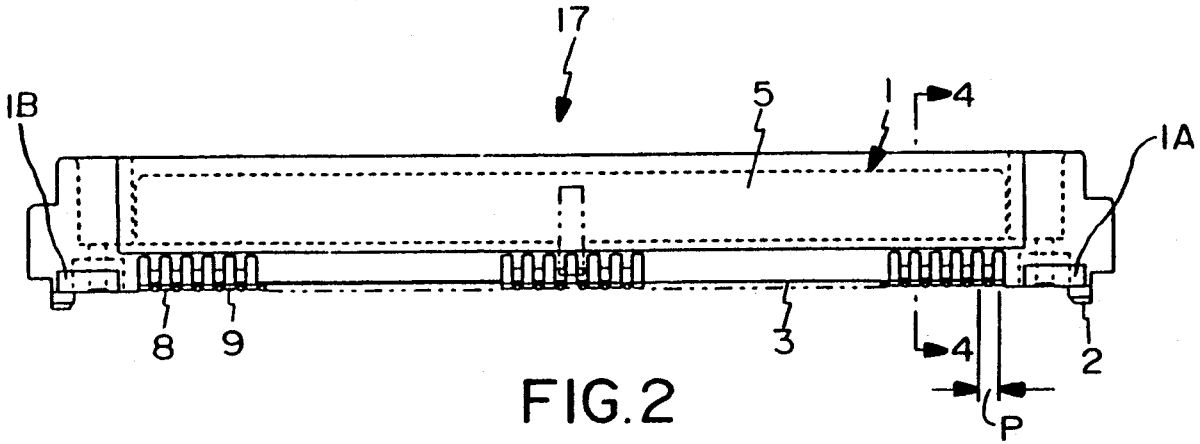
FIG. 2 is a front view of the female part of the electric connector of the first embodiment of the present invention.
Figure 3:
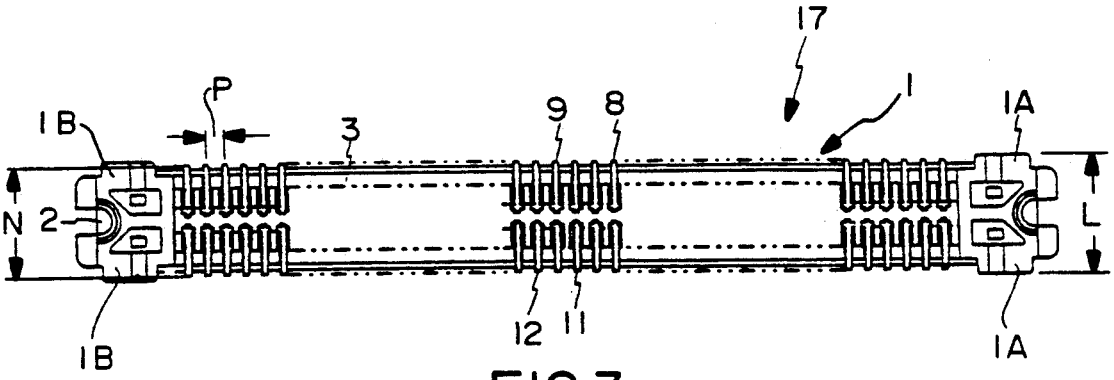
FIG. 3 is a bottom view of the female part of the electric connector of the first embodiment of the present invention.
Figure 4:
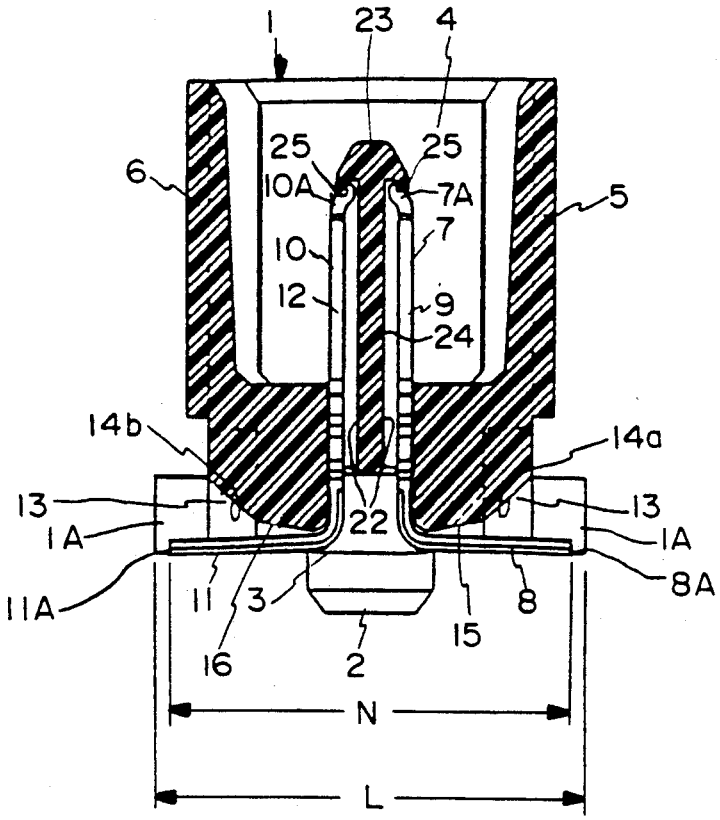
FIG. 4 is a cross-section of the female part of the electric connector, taken along the line A—A in FIG. 2.
Figure 5:
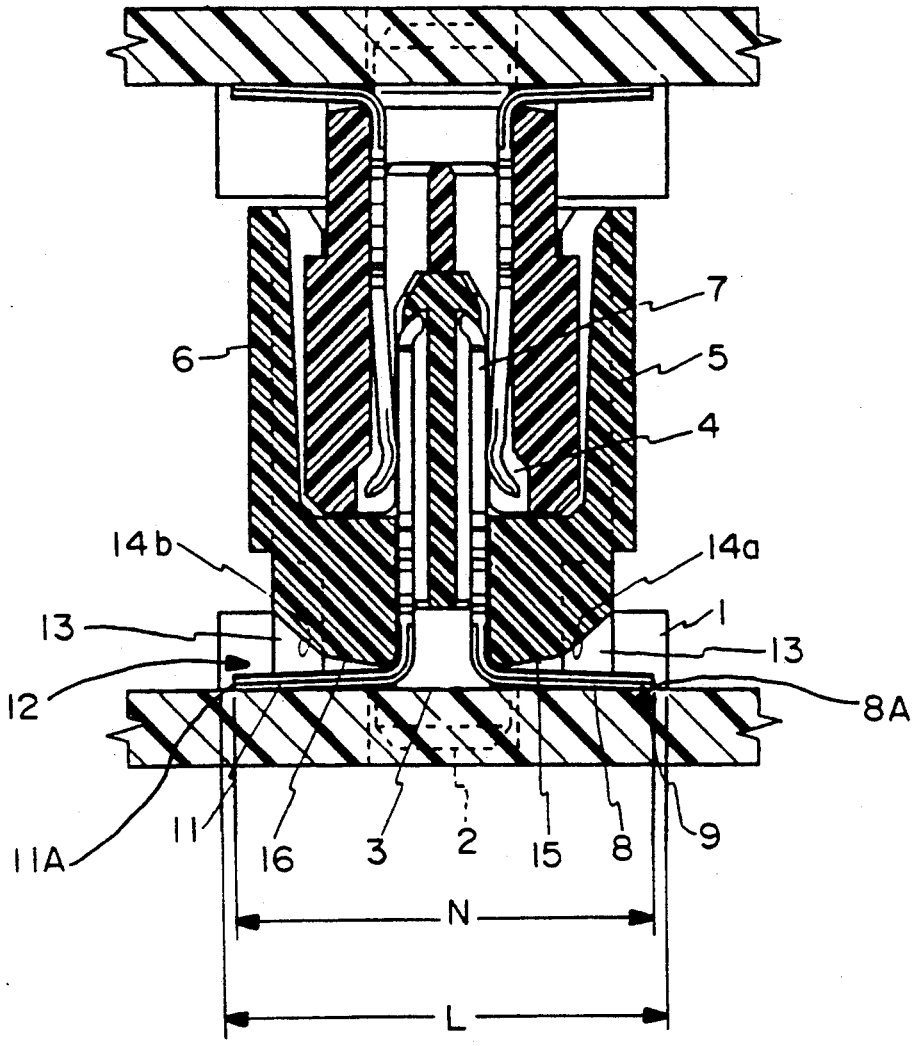
FIG. 5 is a cross-section of the male and female parts of the electric connector when mated together.

FIGS. 1 to 5 show the female part of a thin, applied-to-surface (surface mounted) type of electric connector according to a first embodiment of the present invention. It comprises a housing 1 and a plurality of terminals 9, 12 fixed to the housing in terminal receiving cavities 22 (FIG. 4). These terminals are arranged longitudinally at regular intervals or pitch "p". The housing 1 has posts 2 projecting downward from the opposite ends of its bottom 3, as best seen from FIG. 2. The housing 1 has a longitudinal slot 4 formed in its top to receive the male part of the electric connector, which is attached to a counter printed circuit board. The longitudinal slot 4 runs between the front and rear sides 5 and 6 of the housing 1.

An elongate projection 23 extends into and lengthwise along slot 4. The projection includes a portion 24 of the terminal receiving cavities 22 in opposite sides thereof.

Numerous terminals are arranged and fixed to the housing body 1 in two parallel lines. Each front terminal 9 has a contact 7 and a soldering tail 8 at its opposite ends whereas each rear terminal 12 has a contact 10 and a soldering tail 11 at its opposite ends. These soldering tails 8 and 11 partly extend out of the front and rear sides 5 and 6 of the housing.

The structure described so far is similar to a conventional thin, surface mounted electric connector. The central feature of a thin, surface mounted electric connector according to the present invention is described below.

As best seen in FIG. 4, the distance N between the tail end 8A of each terminal 9 attached to the front side 5 of the housing 1 and the tail end 11A of each terminal 12 attached to the rear side 6 of the housing 1 is shorter than the maximum lateral size L of the housing 1 thus remaining within the maximum lateral size L of the housing 1. The lateral size or width of the housing is defined by the width between stabilizing projections 1A or 1B in this particular embodiment. Stated otherwise, the soldering tail ends 8A and 11A do not extend to the plane in which the stabilizing projections 1A and 1B of the opposite ends of the housing 1 lie. It can be seen that the width of the housing between the stabilizing projections is less than the width L at the stabilizing projections.

In addition, each of the front and rear sides 5 and 6 of the housing has a chamfer 13 along its lower longitudinal part or edge, thus permitting the bending of the tail end of each terminal. Specifically, the chamfer 13 is formed between the lower part of the front side 5 and the plane 3 in which a printed circuit board is to be laid by partly removing the lower edge of the front side 5 in a generally triangular shape 13 to provide a steeply slanted surface 14*a* and a more gently slanted surface 15 along the lower longitudinal part of the front side 5. Likewise, the chamfer 13 is formed between the lower part of the rear side 6 and the plane 3 by partly removing the lower edge of the rear side 5 in the same manner to provide a steeply slanted surface 14*b* and a more gently slanted surface 16 along the lower longitudinal part of the rear side 5. These slanted surfaces of the bottom end of each opposite side facilitate the bending of the solder tails 8 and 11 of the terminals.

In use, a plurality of front and rear terminals 9 and 12 are inserted in the housing 1, and then these terminals are bent around the slanted surfaces of the bottom ends of the front and rear sides 5 and 6. The terminals will be yieldingly bent to form an acute angle, and then will spring back partway to form a 90 degree angle due to the resilience of the terminals. The female part 17 of the electrical connector is placed on a printed circuit board with its front and rear terminal tails 8 and 11 on selected conductors in the printed circuit board, and the printed circuit board along with the female part of the electric connector are put in a soldering vessel in which solder applied beneath the front and rear terminal tails 8 and 11 is exposed to heated air or infrared rays to be melted on selected conductors of the printed circuit board to solder the front and rear terminals of the female part of the electric connector to the selected conductors in the printed circuit board. In the course of soldering, the spaces between the terminal tails 8 and 11 and the slanted surfaces permit the passage of sufficient amount of heated air or infrared rays to assure good soldering on each tail.

As shown in FIG. 4, the end portion 24 of projection 23 ends in a slanted section 25 which slants away from the center of the projection 23 downward towards bottom 3 of housing 1. The tips 7A and 10A of the terminals adjacent the contact 7 and 10 are slanted in a manner similar to slanted sections 25 of the housing projection 23 so that the tips 7A and 10A cannot lift out of their respective cavity.

Figure 6:
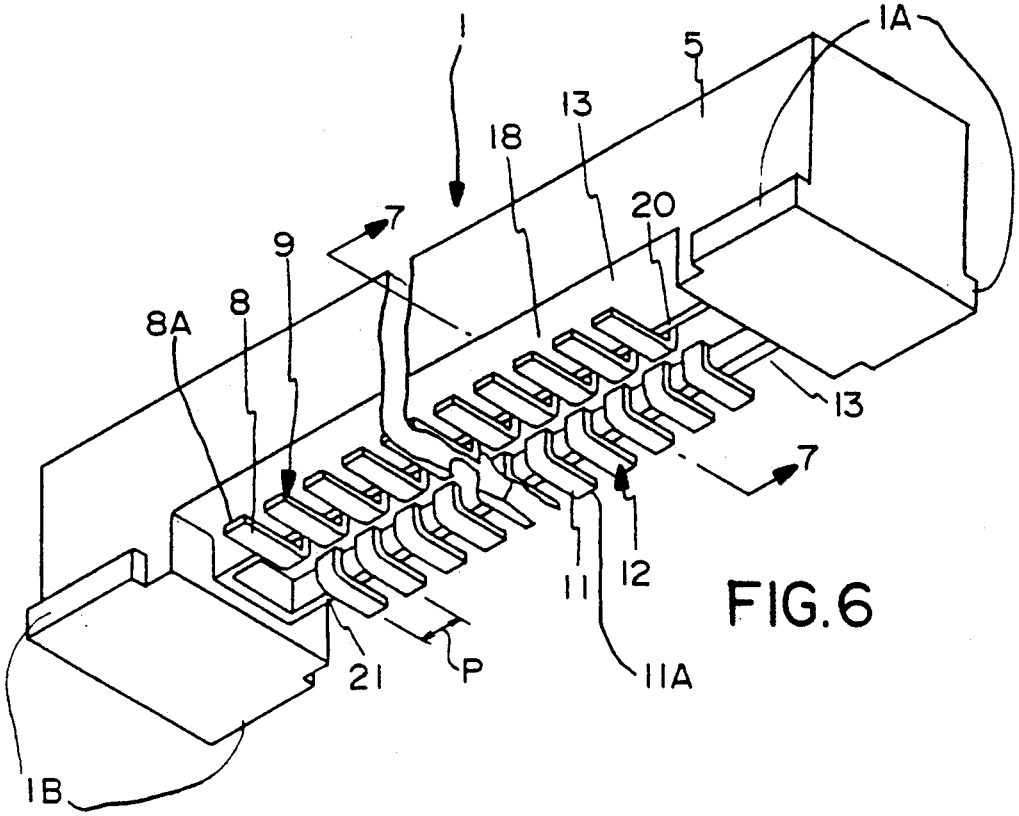
FIG. 6 is a perspective view of the female part of a thin, applied-to-surface type of electric connector according to a second embodiment of the present invention.
Figure 7:
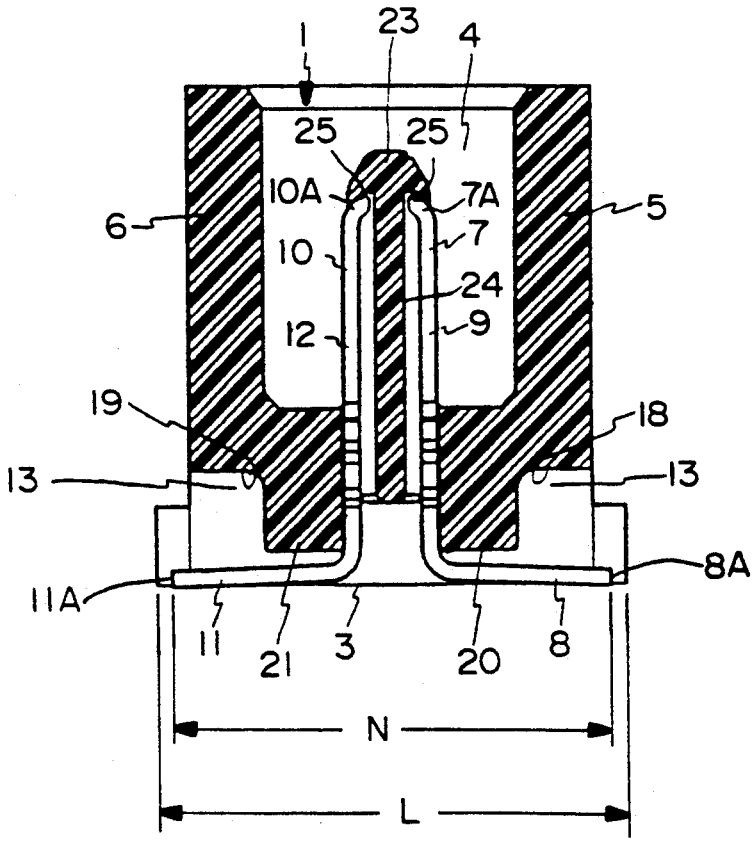
FIG. 7 is a cross-section of the female part of the electric connector of FIG. 6, taken along the line B—B in FIG. 6.

FIGS. 6 and 7 show a second embodiment of the present invention. As best seen from FIG. 7, the chamfer is formed by partly removing the lower edge of each of the front and rear sides 5 and 6 in the form of rectangle to provide the rectilinear recess 13 along the lower longitudinal part of each side. Thus, longitudinal recessed walls 18 and 19 are formed on the bottom ends of the front and rear sides 5 and 6 of the housing 1. A plurality of front and rear terminals 9 and 12 are bent prior to insertion into the housing 1. There remain clearances between the soldering tails 8 and 11 of the front and rear terminals 9 and 12 and the bottom ends 20 and 21 of the front and rear sides 5 and 6. In this particular embodiment the housing 1 has no posts at its opposite ends to hold itself to a printed circuit board.

As may be understood from the above, the terminal tails are positioned within the maximum lateral size L of the connector housing, thus requiring no extra space in mounting the connector housing to a printed circuit board. Such a design still assures that the solder tails are exposed to a sufficient amount of heat to cause the melting of the solder applied thereon and to provide a good solder joint to each terminal.

We claim:

1. In an electrical connector for surface mounting to a circuit board, including:

an elongate dielectric housing having a board mounting face and a pair of stabilizing projections extending in opposite directions outward from sidewalls of said housing away from the longitudinal centerline of said housing, and a pair of rows of terminal receiving cavities including a portion extending through said mounting face, said rows being positioned on opposite sides of the longitudinal centerline of said housing and extending in a direction generally parallel to said longitudinal centerline;

a plurality of terminals secured within respective ones of said cavities, each terminal including a contact portion for contacting a mating electrical component, a securing section having securing means for securing said terminal within said housing and a tail portion extending from said securing section for soldering said terminal to a selected conductor on said circuit board, a portion of said tail portion extending under said board mounting face, the tail portions of the terminals positioned in one of said rows of cavities extending in a first direction away from said longitudinal centerline and the tail portions of the terminals positioned in the other of row of cavities extending in a second, opposite direction away from said longitudinal centerline, said tail portions being generally perpendicular to said contact portions and said securing section;

characterized in that:

the lateral distance between the ends of tail portions of the terminals positioned int he two rows of cavities is less than the lateral distance between the two oppositely extending stabilizing projections; and the sidewalls have a recess adjacent the board mounting face to facilitate bending of the tail portion of the terminals, wherein said recess is generally triangular and includes a first portion having a first slope relative to the board mounting face and positioned to generally abut the intersection between said tail portion and said terminal securing section to facilitate bending of said terminal to position said tail portion at its operative position, and a second adjacent slop steeper than said first slope relative to said board mounting face to allow sufficient access to said tail portion to permit surface mount soldering of said tail portion to said circuit board.

2. The electrical connector of claim 1 wherein each sidewall of said housing includes a pair of said stabilizing projections extending outward therefrom.

3. The electrical connector of claim 2 wherein the lateral distance between said sidewalls is less than the lateral distance between the ends of tail portions of the terminals positioned int he two rows of cavities.

4. The electrical connector of claim 1 wherein said housing includes an elongate center projection extending along the longitudinal centerline thereof and a portion of said terminal receiving cavities extends along opposite sides of said center projection, the end of said cavities adjacent the end of said center projection being sloped away from the longitudinal centerline of the housing and away from the end of the center projection, and the ends of said terminals received at said ends of the cavities are similarly sloped to secure the ends of the terminals within their respective cavities.

* * * * *